US009133653B2

(12) United States Patent
Rasel et al.

(10) Patent No.: US 9,133,653 B2
(45) Date of Patent: Sep. 15, 2015

(54) CLOSURE DEVICE

(75) Inventors: Wolfgang Rasel, Rudesheim (DE); Klaus Brandscheid, Geisenheim (DE); Heiko Dietrich, Darmstadt (DE); Hans Geiser, Niedergailbach (DE)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 549 days.

(21) Appl. No.: 13/352,381

(22) Filed: Jan. 18, 2012

(65) Prior Publication Data

US 2012/0186157 A1 Jul. 26, 2012

(30) Foreign Application Priority Data

Jan. 20, 2011 (DE) ..... 10 2011 008 992

(51) Int. Cl.

| | |
|---|---|
| ***E05C 19/00*** | (2006.01) |
| ***E05B 83/16*** | (2014.01) |
| ***E05B 81/20*** | (2014.01) |
| ***E05F 15/603*** | (2015.01) |
| ***E05F 15/70*** | (2015.01) |
| *E05B 81/70* | (2014.01) |

(52) U.S. Cl.

CPC ..... *E05B 83/16* (2013.01); *E05B 81/20* (2013.01); *E05F 15/603* (2015.01); *E05F 15/70* (2015.01); *E05B 81/70* (2013.01); *E05Y 2201/42* (2013.01); *E05Y 2201/426* (2013.01); *E05Y 2400/358* (2013.01); *E05Y 2900/531* (2013.01); *E05Y 2900/546* (2013.01)

(58) Field of Classification Search

USPC ..... 292/1, 216, 201

See application file for complete search history.

(56) References Cited

U.S. PATENT DOCUMENTS

| | | | | |
|---|---|---|---|---|
| 4,762,348 | A | 8/1988 | Matsumoto | |
| 5,934,717 | A * | 8/1999 | Wirths et al. | 292/201 |
| 6,430,875 | B1 * | 8/2002 | Clark et al. | 49/360 |

(Continued)

FOREIGN PATENT DOCUMENTS

| | | |
|---|---|---|
| DE | 10155836 A1 | 6/2003 |
| DE | 10326416 A1 | 12/2004 |

(Continued)

OTHER PUBLICATIONS

UK IPO, British Search Report for Application No. 1200685.4, dated May 17, 2012.

German Patent Office, German Search Report for Application No. 102011008992.6, dated Nov. 21, 2011.

*Primary Examiner* — Mark Williams

(74) *Attorney, Agent, or Firm* — Ingrassia Fisher & Lorenz PC

(57) ABSTRACT

A closure device is provided for opening and/or re-closing a wall element, with an unlocking/locking device for opening and re-closing the wall element. A holding device is provided by which the wall element is arranged in a first function position from which it is re-closed again or by which the wall element is arranged in a second function position, from which the wall element is openably held. A control device is provided that releases a tensioning device of the unlocking/locking device. For a first release period with which the wall element is loaded with a force in the direction of the second function position. When the wall element on actuation of an actuating device is closed or arranged in the first function position and at least locks the tensioning device after the second release period when the wall element on actuating the actuating means is opened.

20 Claims, 4 Drawing Sheets

(56) References Cited

U.S. PATENT DOCUMENTS

| | | | |
|---|---|---|---|
| 6,435,573 | B1 | 8/2002 | Szablewski |
| 2004/0255626 | A1 | 12/2004 | Petasch et al. |
| 2006/0164029 | A1 | 7/2006 | Suzuki et al. |
| 2010/0032965 | A1 | 2/2010 | Kargilis et al. |

FOREIGN PATENT DOCUMENTS

| | | | |
|---|---|---|---|
| DE | 102007025309 | A1 | 12/2008 |
| EP | 0991832 | B1 | 3/2005 |
| WO | 2004029392 | A1 | 4/2004 |
| WO | 2011070858 | A1 | 6/2011 |

* cited by examiner

CLOSURE DEVICE

CROSS-REFERENCE TO RELATED APPLICATION

This application claims priority to German Patent Application No. 102011008992.6, filed Jan. 20, 2011, which is incorporated herein by reference in its entirety.

TECHNICAL FIELD

The technical field relates to a closure device for opening and/or re-closing a wall element such as a door or tailgate, particularly of a motor vehicle, a control device for controlling such a closure device and a method for opening and re-closing a wall element.

BACKGROUND

Closure devices are known with motor vehicles. With a known closure device, a wall element designed as tailgate is pushed open in opening direction by means of a pop-up system following actuation of an actuating means. Here, the pop-up system designed as tensioning means pushes the tailgate open with a force that is just adequate to open the tailgate past the main latch and pre-latch so far, that it can then be opened manually or automatically.

The closure device must also function in adverse weather conditions, for example very low temperatures. To this end, the force that acts on the wall element for opening through the tensioning means is adapted to the adverse circumstances. In weather conditions, where there are high ambient temperatures, for example, the energy that is available to the closure device through the tensioning means is increased such that the tailgate is not only pushed open in the direction of the pre-latch but beyond that. Therefore, the tailgate falls back in the direction of the pre-latch once it has reached a point of return. Because of this, the tailgate can have a kinetic energy when striking the pre-latch that is adequate to overcome the pre-latch in closing direction. In such a case, the tailgate falls back as far as to the latching position of the main latch.

By means of the pre-latch, the tailgate is automatically closed again. A user then has to actuate the actuating means again in order to open the tailgate, which has proved to be impractical and bothersome. In addition, a user can unintentionally touch and actuate the actuating means when closing the open wall element, as a result of which the wall element for example during manual closing by a user is not locked in the closed position but is pushed open again by the tensioning means, which has likewise proved to be impractical and bothersome. From US 2010/0032965 A1 a closure device is known with a tailgate that is automatically pushed open again as a function of the position of the tailgate.

In view of the foregoing, it is at least one object is to propose a closure device with a reduction of the danger of unintentional re-closing and/or opening of the wall element. In addition, other objects, desirable features, and characteristics will become apparent from the subsequent summary and detailed description, and the appended claims, taken in conjunction with the accompanying drawings and this background.

SUMMARY

A closure device is provided for opening and/or re-closing a wall element such as a door or tailgate, particularly of a motor vehicle, with an unlocking and/or locking device for opening a re-closing the wall element, with a holding device by means of which the wall element is re-closed in a first function position. It is returned from the first function position, in particular automatically or by means of which the wall element can be arranged in a second function position, out of which the wall element is held capable of being opened and with a control device. The control device releases at least one tensioning means of the unlocking and/or locking device. The wall element can be loaded with a force in the direction of the second function position for a defined first release period, when the wall element on actuation of an actuating means is closed or arranged in the first function position. It locks at least the tensioning means after a certain second release period when the wall element on actuation of the actuating means is opened.

The force, with which the wall element is loaded in the direction of the second function position, is preferably just adequate that the wall element can be arranged in the second function position in the event of the presence of particularly adverse weather conditions such as for example particularly low ambient temperatures. The second function position is, seen in opening direction, arranged after the first function position. First function position and second function position can comprise a certain position or a region of a plurality of positions.

The actuating means can be designed in any way and for example, comprise a key, particularly an electrical key or an actuation switch such as an unlocking button, particularly a touch button. In principle, it is possible that the first release period and the second release period are identical in length. Furthermore, it is conceivable that the first release period and the second release period differ from each other. Preferably, the first release period is longer than the second release period.

Preferably, the first release period is just longer than the time mechanically required in total in order to push open the wall element, reach the point of return above the second function position, fall back into the first function position, to be pushed open again and finally remain in the second function position. The second release position is preferably just so much shorter than the time that is required in total in order to close the wall element.

It is advantageous if the first release period comprises between approximately 150 and approximately 1000 milliseconds, preferably between approximately 200 and approximately 850 milliseconds, preferably between approximately 300 and approximately 700 milliseconds and/or the second release period between approximately 0 and approximately 200 milliseconds, preferably between approximately 0 and approximately 150 milliseconds, preferably between approximately 0 and approximately 100 milliseconds. In that, the control device senses if the wall element is opened during closing the second release period can be selected particularly short. Because of this it is avoided that the wall element unintentionally re-opens following for example manual closing.

Here it proves to be particularly advantageous if the first function position is formed between a first latch and a second latch, particularly main latch and pre-latch, and/or the second function position above the second latch, particularly pre-latch. In particular, it is conceivable that at least between the first latch and the second latch further latches are provided. Furthermore, at least one further latch can also be provided in opening direction behind the second latch.

In principle, it is conceivable that the tensioning means of the unlocking and/or locking device is tensioned for example by a drive. However, it is preferred when the tensioning means during closing of the wall element can be tensioned automatically, particularly by the wall element. The tensioning means can be hydraulic or electrical. If the tensioning means is mechanical, it proves to be advantageous if the tensioning means comprises at least one spring element. The spring element can be tensioned when closing the wall element in a simple manner in that the at least one spring element is compressed, wherein energy can be stored in the compression. In such a case, the tensioning element can comprise a gas spring.

With a further development, at least one sensor unit is provided with which it is at least noticeable if the wall element is open or closed. The sensor unit preferably acts together with the control device so that the control device is able to sense by means of the sensor unit if the wall element is open or closed. In addition to this, the control device by means of the sensor device can sense it if the wall element is in the second function position. In such a case, it would be conceivable that the control device fixes the tensioning means when sensed by means of the sensor unit that the wall element is arranged in the second function position, even when the first period has not yet expired.

In order to fix the wall element when it is advantageous when the unlocking and/or locking device comprises a bolting means that can in particular be switched through the control device, with which the in particular closed wall element can be fixed on a keeper, in particular closing bracket. In such a case, unintentional re-opening of the wall is prevented. In addition, it is advantageous if the unlocking and/or locking device is designed electrically activatable through the control device and/or the releasing of the tensioning device comprises an energizing of the unlocking or locking device. In such a case, the releasing of the tensioning means through the control device comprises an extension of the energizing time of the unlocking and/or locking device. When the unlocking and/or locking device is not energized, it preferably locks the tensioning means.

A control device is also provided for controlling a closure device that in particular is suitable for a closure device having the aforementioned features. The control device is designed at least in such a manner that a tensioning means of the unlocking and/or locking device can be released or fixed by said control device.

In addition, a method is provided for the opening and re-closing of a wall element, such as door or tailgate, particularly of a motor vehicle, with an unlocking and/or locking device, with a holding device and with a control device with which a tensioning means can be released and fixed with the steps: actuating an actuating device, particularly by a user; sensing through the control device if the wall element is closed or opened; when the wall element is closed; releasing of a in particular electrically activatable tensioning means of the unlocking and/or locking device for a defined first release period; loading of the wall element with a force through the tensioning means when the wall element is closed or is arranged in a first function position of the holding device; re-fixing of the tensioning means following expiration of the defined first release period through the control device; or when the wall element is open: releasing of a particularly electrically activatable tensioning means of the unlocking and/or locking device for a defined second release period; and fixing of the tensioning means of the unlocking and/or locking device after expiration of the second release period.

In the following, substantially closed is to mean that the wall element is in the closed state or arranged in the first function position of the holding device. In that the tensioning means of the unlocking and/or locking device is released for the defined first release period, the wall element is also loaded with a force if following the pushing open through the tensioning means in the direction of the second function position it should again fall back as far as into the first function position. Therefore, it is ensured that the tensioning means in such a case automatically acts again on the wall element with a force for the opening of the wall element.

The force with which the tensioning means acts on the wall element when the wall element is in the first function position is preferentially lower than the force with which the tensioning means acts on the wall element when the latter is closed. Because of this, a possible reversal point of the wall element during the opening operation is lower than when the wall element is opened through the tensioning means from the closed state. Because of this the kinetic energy of the wall element when striking the second function position is also less, because of which it is not adequate for overcoming the second function position.

Here it is of special advantage that the user need not again actuate the actuating means in order to open the wall element. In that a second release period is provided, the wall element is closable without automatically re-opening from the closed position through the tensioning means. In such a case it proves advantageous when the second release period is less than the for example manual closing of the wall element. Preferably, the first release period comprises between approximately 150 and approximately 1000 milliseconds, preferably between approximately 200 and approximately 850 milliseconds, preferably between approximately 300 and approximately 700 milliseconds and/or the second release period between approximately 0 and approximately 200 milliseconds, preferably between approximately 0 and approximately 150 milliseconds, preferably between approximately 0 and approximately 100 milliseconds.

It proves to be advantageous when before or with the unlocking or locking of the tensioning means of the unlocking and/or locking device a bolting means of the unlocking and/or locking device is released or fixed through the control device. When the bolting means is released, the wall element can be easily opened. When the bolting means is fixed, the wall element is held in the closed position. In addition, it proves to be advantageous when the control device determines by means of at least one sensor unit if the wall element is open or closed. In such a case, the first release period and/or second release period can be simply selected.

Upon a further development of the method it is provided that the control device through the at least one sensor unit senses if the wall element is arranged in the second function position. In such a case, the control device can fix the tensioning means when the wall element is already arranged in the second function position.

Finally, it proves to be advantageous when the tensioning means during the closing of the wall element is automatically tensioned. Because of this, the forces to be applied when opening and re-closing can be efficiently converted and/or utilized.

The method according to the invention and the closure device according to the invention prove to be advantageous in multiple respects. In that the tensioning means is released through the control device for a defined first release period, the wall element is not only pushed out of the closed position in the direction of the second function position but also again even when the wall element has fallen back into the first function position. In such a case, the actuating means need not be again actuated by a user. In addition to this, providing a defined second release period proves to be advantageous in such a manner that the tensioning means is already fixed through the control device when the wall element is closed for example by a user. Because of this, a renewed pushing open of the wall element through the tensioning means is prevented.

BRIEF DESCRIPTION OF THE DRAWINGS

The present invention will hereinafter be described in conjunction with the following drawing figures, wherein like numerals denote like elements, and.

DETAILED DESCRIPTION

Figures 1A, 1B, 1C:
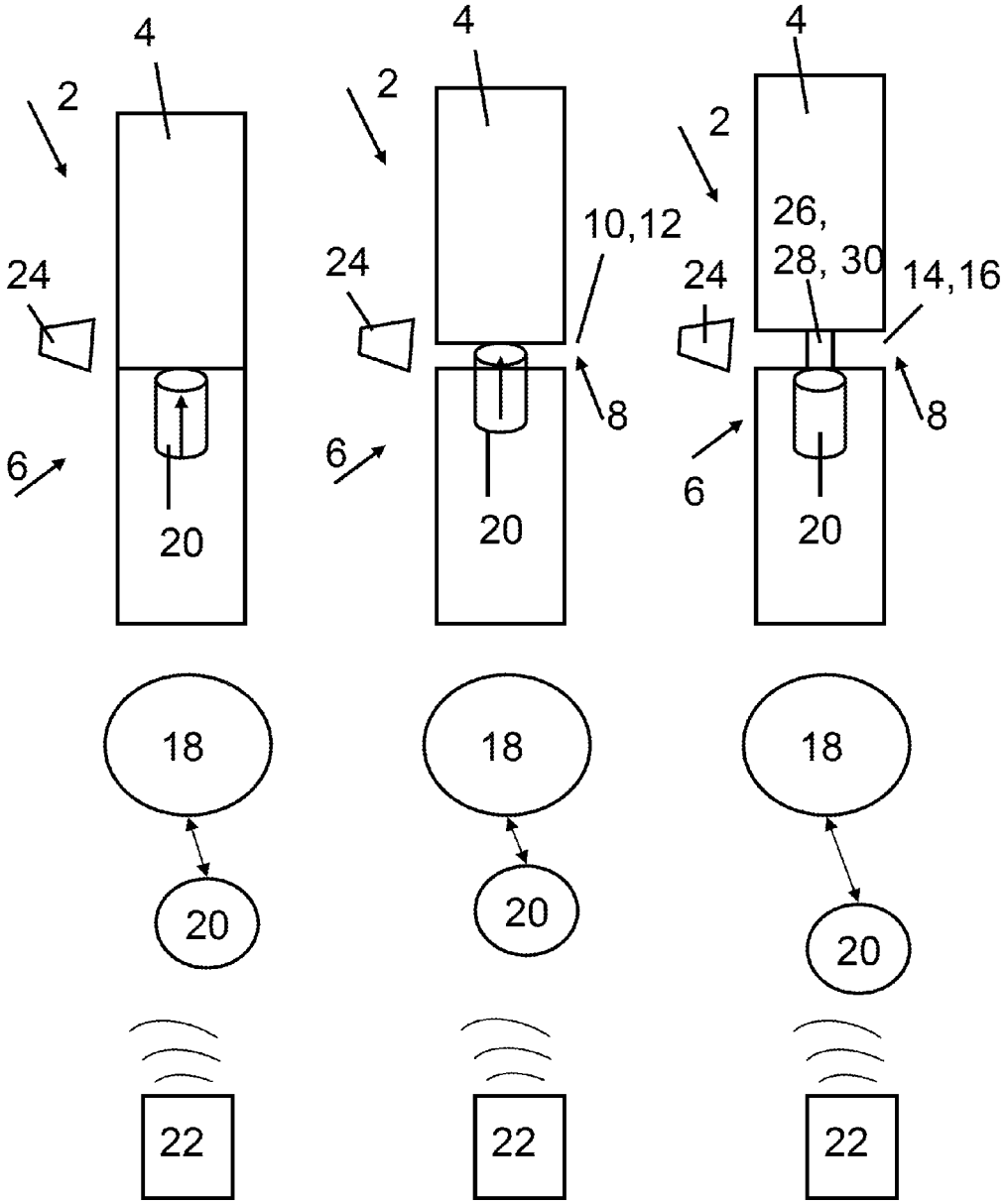
FIG. 1*a*-FIG. 1D are area schematic representations of a closure device According to an embodiment.
Figure 1D:
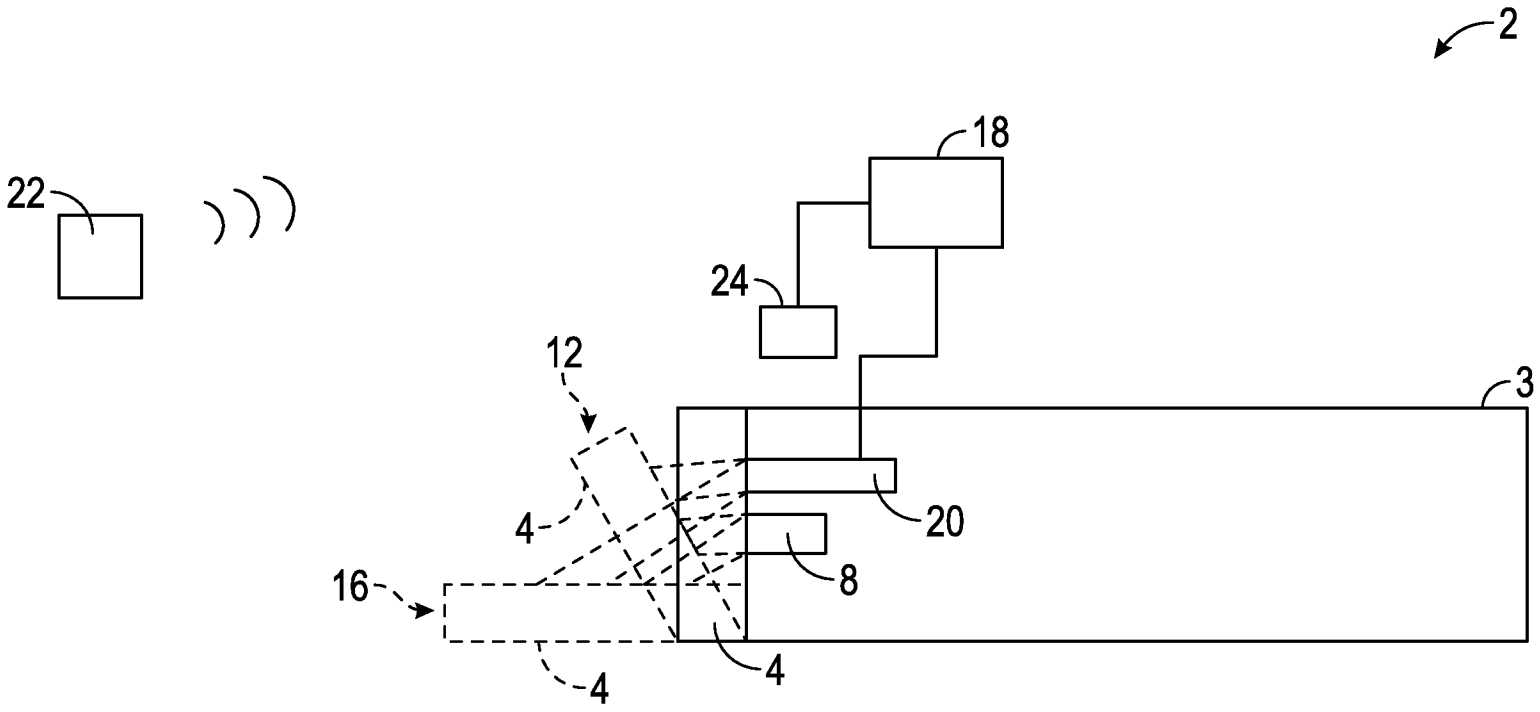

The following detailed description is merely exemplary in nature and is not intended to limit application and uses. Furthermore, there is no intention to be bound by any theory presented in the preceding background or summary or the following detailed description.

FIG. 1*a* to FIG. 1D show a schematic representation of a closure device altogether provided with a reference character 2 for opening and/or re-closing of a wall element 4, such as door or tailgate, particularly of a motor vehicle 3. The closure device 2 comprises a tensioning means 20 of an unlocking and/or locking device 6 for opening and re-closing the wall element 4.

The wall element 4 can be arranged by means of a holding device 8, in a first function position 12 designed as first latch 10 (shown in FIG. 1*b*), from which the wall element 4, is in particular automatically closed again or arranged in a second function position 16 formed above a second latch 14, from which the wall element 4 is openably held. The first function position 12 in this case is formed between the first latch 10 and the second latch 14.

Figure 3:
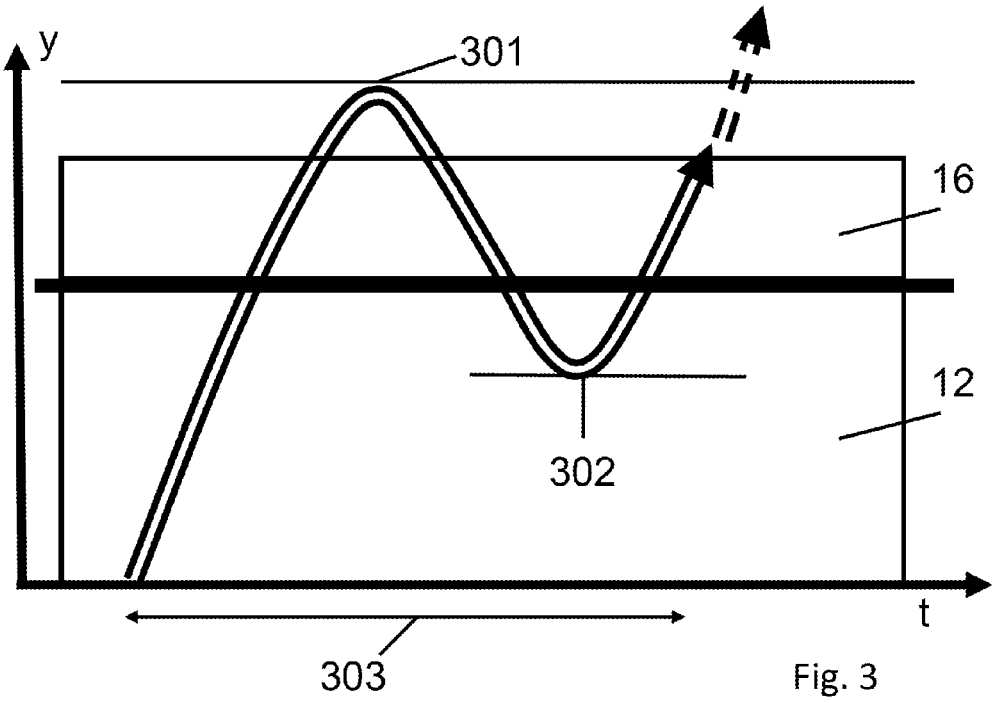
FIG. 3 is a schematic representation of the opening height plotted over the time during the opening of a wall element.
Figure 4:
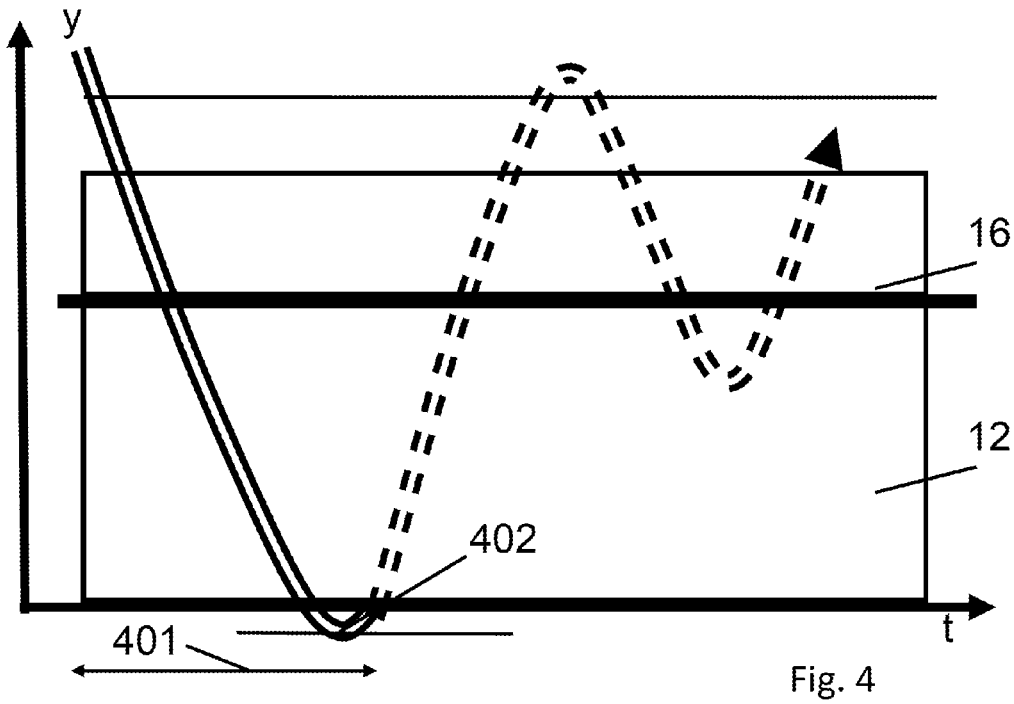
FIG. 4 is a schematic representation of the opening height plotted over the time during the closing of a wall element.

The closure device 2 additionally comprises a control device 18, with which the at least one tensioning means 20 of the unlocking and/or locking device 6 can be released for a first release period 303 (shown in FIG. 3) or a second release period 401 (shown in FIG. 4). The tensioning means 20 is released through the control device 18 for the defined first release period 303, when the wall element 4 on actuation of an actuating means 22 is closed or arranged in the first function position 12. The tensioning means 20 is released through the control device 18 for the defined second release period 401, when the wall element 4 on actuation of the actuating means 22 is opened.

Through the tensioning means 20 the wall element 4 can be loaded with a force in the direction of the second function position 16. For sensing if the wall element 4 is open or closed, a sensor unit 24 is provided, which interacts with the control device 18. In order to fix the wall element 4 in its closed position, the unlocking and/or locking device 6 comprises a bolting means 26 that can be switched in particular through the control device 18, with which the in particular closed wall element 4 can be fixed to a keeper 28, in particular a closing bracket 30.

Figure 2:
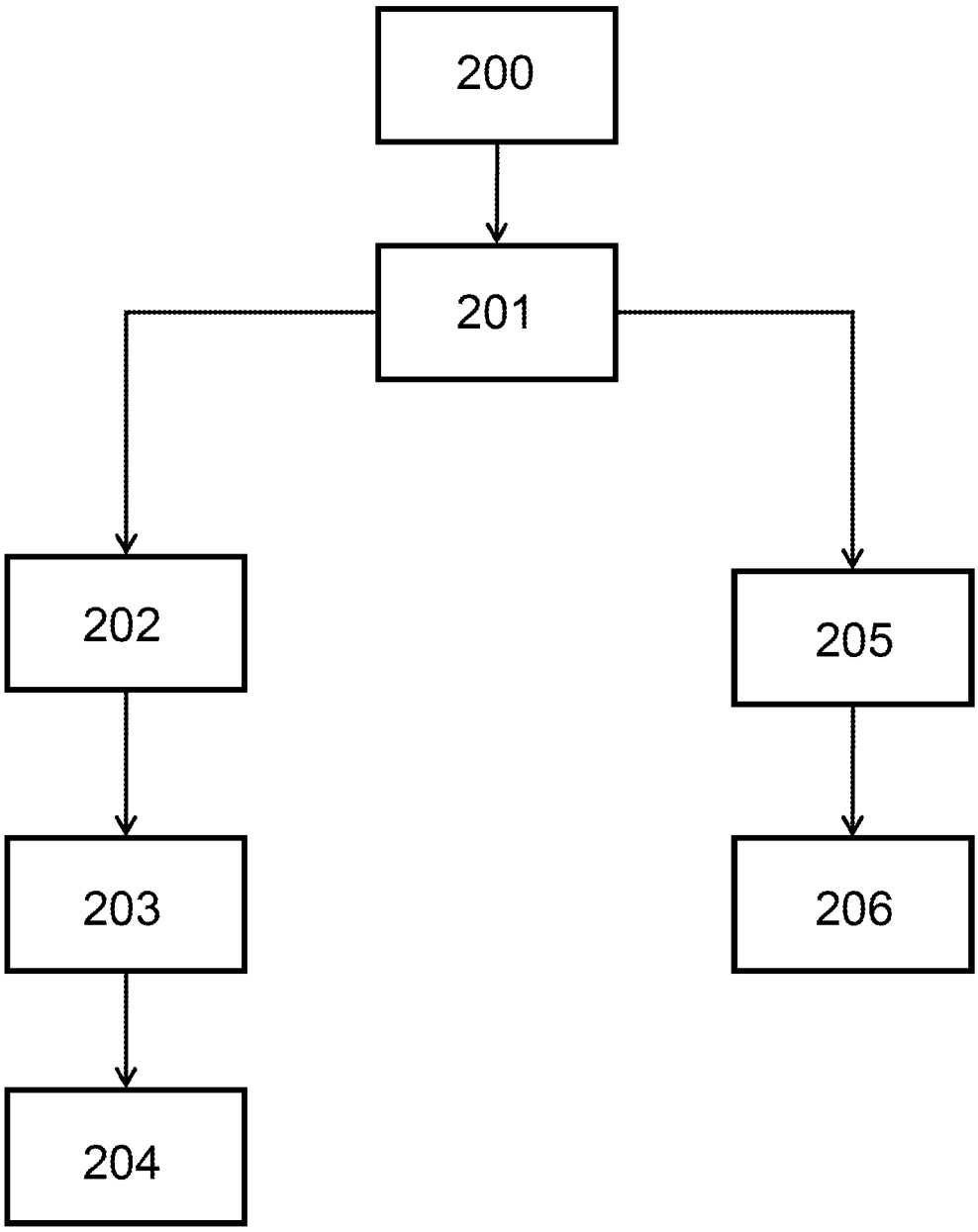
FIG. 2 is a schematic representation of a method according to an embodiment.

The operating mode of the closure device 2, in particular through the corresponding method for the opening and re-closing of the wall element 4, is described by means of FIG. 2. In a first step 200, the actuating means 22 is for example actuated by a user. By actuating the actuating means 22 the control device 18 is prompted in a step 201 to sense by means of the sensor unit 24 if the wall element 4 is closed or opened. Here substantially closed is to mean that the wall element 4 is in the closed position or arranged in the first function position 12 of the holding device 8.

If it is determined through the control device 24 in step 201 that the wall element 4 is closed or is in the first function position 12, the control device 24 in a step 201 releases the tensioning means 20 of the unlocking and/or locking device 6 for the defined first release period 303. Through the releasing of the tensioning means 20 in the step 202, the wall element 4 in the following step 203 is loaded through the tensioning means 20 with a force so that it is moved, in particular pushed, in the direction of the second function position 16 of the holding means 8. Because of this, the wall element 4 is again loaded through the tensioning means 20 with a force in opening direction if it should fall back into the first function position 12. In such a case, step 201 is repeated.

Following expiration of the defined first release period 303 the tensioning means 20 in the final step 204 is again fixed through the control device 18. However, if the wall element 4 in the step 201 is in an opened position, the tensioning element 20 is released through the control device 18 for a defined second release period 401 in a step 205. Following the expiration of this defined second release period 401, the tensioning means 20 is again fixed through the control device 18 in a final step 206. The second release period 401 in such a case is not sufficient to move and because of this re-open the wall element 4 again in the direction of the second function position 16 of the holding means 8.

FIG. 3 shows a representation of the open height y of the wall element 4 over the time t plotted during the opening of the wall element 4. This makes it clear that the wall element 4 can be moved beyond the region of the second function position 16 through the tensioning means 20. Following the reaching of a first reversal point 301, the wall element 4 falls back in the direction of the closed position. In this case, the kinetic energy if applicable is of such a magnitude that the wall element 4 falls back through the region of the second function position 16 into the region of the first function position 12. There, the wall element 4 is again loaded through the tensioning means 20 with a force in opening direction. In FIG. 3, the renewed force loading takes place at a second reversal point 302.

In that the second reversal point 302 is arranged above the closed position of the wall element 4, the force with which the tensioning means 20 acts on the wall element 4 is reduced. Because of this, the wall element 4 through the second prevented push is arranged in the second function position 16, out of which the wall element 4 can be opened. Here, the first release period 303 is at least as long as the previously described opening operation takes.

FIG. 4 shows a representation of the opening height y of the wall element 4 plotted over the time during the closing of the wall element 4. The wall element 4 in such a case is closed manually or automatically. The second release period 401 in this case is selected so that the tensioning means 20 is fixed when the wall element 4 reaches a third reversal point 402. Because of this, an automatic re-opening of the wall element 4 is prevented.

While at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A closure device for operating a wall element of a motor vehicle, the closer device comprising:

an actuating device that receives an input to open and re-close the wall element;

a holding device that arranges the wall element in a first function position from which the wall element is automatically closable or a second function position from which the wall element is held open, the first function position formed between a first latch and a second latch, and the second function position is formed adjacent to the second latch, between the first function position and the second latch;

a tensioning device coupled to the wall element and in communication with a control device; and the control device configured to:

(a) release the tensioning device for a first release period with which the wall element is loaded with a force in a direction of the second function position based on the input received by the actuating device when the wall element is arranged in the first function position or closed; and (b) lock the tensioning device after a second release period based on the input received by the actuating device when the wall element is positioned in the second function position.

2. The closure device according to claim 1, wherein the first release period is between approximately 150 and approximately 1000 milliseconds.

3. The closure device according to claim 1, wherein the first release period is between approximately 200 and approximately 850 milliseconds.

4. The closure device according to claim 1, wherein the first release period is between approximately between approximately 300 and approximately 700 milliseconds.

5. The closure device according to claim 1, wherein the second release period is between approximately 0 and approximately 200 milliseconds.

6. The closure device according to claim 1, wherein the second release period is between approximately 0 and approximately 150 milliseconds.

7. The closure device according to claim 1, wherein the second release period is between approximately 0 and approximately 100 milliseconds.

8. The closure device according to claim 1, wherein the wall element is held in the second function position.

9. The closure device according to claim 1, wherein the tensioning device is configured to automatically tension during the closing of the wall element.

10. The closure device according to claim 1, further comprising a sensor unit configured to detect if the wall element is open.

11. The closure device according to claim 1, further comprising a bolting device that is actuated by the control device to fix the wall element to a keeper.

12. The closure device according to claim 1, wherein the closure device further comprises an unlocking/locking device is electrically activatable through the control device.

13. The closure device according to claim 12, wherein releasing of the tensioning device comprises an energizing of the unlocking/locking device.

14. A closure device for operating a tailgate of a motor vehicle, the closure device comprising:

an actuating device that receives an input to open and re-close the tailgate;

a holding device that arranges the tailgate in a first function position from which the tailgate is automatically closeable or a second function position from which the tailgate is held open, the first function position formed between a first latch and a second latch, and the second function position is formed adjacent to the second latch, between the first function position and the second latch:

a tensioning device coupled to the wall element and in communication with a control device; and the control device configured to:

(a) release the tensioning device for a first release period with which the tailgate is loaded with a force in a direction of the second function position based on the input received by the actuating device when the tailgate is arranged in the first function position; and (b) lock the tensioning device after a second release period based on the input received by the actuating device when the tailgate is positioned in the second function position.

15. The closure device according to claim 14, wherein the tensioning device is configured to automatically tension during the closing of the tailgate.

16. The closure device according to claim 14, further comprising a sensor unit in communication with the control device that detects that the tailgate is open.

17. The closure device according to claim 14, wherein the closure device further comprises a bolting device that is actuated by the control device to fix the tailgate to a keeper.

18. A closure device for operating a wall element of a motor vehicle, the closure device comprising:

an actuating device that receives an input to open and re-close the wall element;

a holding device that arranges the wall element in a first function position from which the wall element is automatically closeable or in a second function position from which the wall element is held open, the first function position formed between a first latch and a second latch, and the second function position formed adjacent to the second latch, between the first function position and the second latch:

a tensioning device that automatically increases tension during closing of the wall element, and the tensioning device comprises a hydraulic device coupled to the wall element and in communication with a control device; and the control device configured to:

release the tensioning device for a first release period with which the wall element is loaded with a force in a direction of the second function position based on the input received by the actuating device when the wall element is arranged in the first function position or closed; and (b) lock the tensioning device after a second release period based on the input received by the actuating device when the wall element is positioned in the second function position.

19. The closure device according to claim 18, wherein the closure device further comprises an unlocking/locking device that is electrically activatable through the control device.

20. The closure device according to claim 19, wherein releasing of the tensioning device comprises an energizing of the unlocking/locking device.

* * * * *